United States Patent [19]

Kemp, Jr. et al.

[11] 4,062,497

[45] Dec. 13, 1977

[54] GRINDING MILL SYSTEM HAVING PROPORTIONING FEEDER

[75] Inventors: Dennis E. Kemp, Jr., Maplewood; Walter Olden Wright, Plainsboro, both of N.J.

[73] Assignee: Application Dynamics, Inc., South Orange, N.J.

[21] Appl. No.: 701,595

[22] Filed: July 1, 1976

[51] Int. Cl.[2] ..... B02C 23/12

[52] U.S. Cl. ..... 241/34; 241/80; 241/171; 241/DIG. 10

[58] Field of Search ..... 241/33, 34, 80, 171, 241/186 A, 186.4, DIG. 10

[56] References Cited

U.S. PATENT DOCUMENTS

| | | | |
|---|---|---|---|
| 657,998 | 9/1900 | Williams | 241/80 |
| 1,825,333 | 9/1931 | Catlin | 241/80 |
| 2,152,367 | 3/1939 | Smith | 241/34 |
| 3,429,511 | 2/1969 | Budzich | 241/80 |

*Primary Examiner*—Granville Y. Custer, Jr.
*Attorney, Agent, or Firm*—Mark T. Basseches; Paula T. Basseches

[57] ABSTRACT

The present invention relates to a grinding mill system including a ball mill, rod mill, or the like, the system being characterized by an improved, simple and highly effective proportioning feed device for automatically optimizing through-put under any of a series of differing operating conditions. The system automatically proportions raw material to be ground with partially ground but oversize materials in an efficient manner without the use of complex and expensive electronic and like sensing devices and circuits.

6 Claims, 4 Drawing Figures

28
29
51
50
4
4
31
49'
27
26
44
48
42
43
46
33
41
45
32
14
49
47
24
40
39
25
49"
3
3

GRINDING MILL SYSTEM HAVING PROPORTIONING FEEDER

BACKGROUND OF THE INVENTION

1. Field of the Invention

The present invention is in the field of grinding devices, and more particularly devices for grinding various solid materials such as sand, coal, ores or the like which are randomly sized within certain ranges when received and must be reduced to a predetermined smaller size range for further processing.

2. The Prior Art

As is well known, it is frequently necessary to grind solid particulate matter, such as sand, ores, etc. as an interim step in the utilization of such material. The grinding is typically effected in mills, such as ball or rod mills.

It is, of course, desirable to utilize the milling capacity in an efficient manner, whereby the maximum throughput of material milled to the desired size range is achieved.

In milling systems heretofore known, various means have been proposed to optimize efficiency. In virtually all such systems, materials are continuously introduced into the mill and at the same time increments of milled materials extracted. The extracted materials may include increments reduced to the desired range and further increments which, while larger than desired, are nonetheless smaller than the raw particulate starting material.

In accordance with known practice, the material which has been subjected to the milling operation is classified, as by known air classifiers or the like, the suitably sized finished product or "fines" being removed and the partially ground material reintroduced to the mill along with increments of raw materials.

The proportioning of raw material to partially ground material has been found significantly to affect milling efficiency and various automatic proportioning means have been suggested. In accordance with one such system, microphones are employed as sensors to determine by the nature of the sounds emitted in the mill, the time, amount and proportion in which additional materials are to be fed to and extracted from the mill.

Various other types of controls relying upon differential air pressures, photoelectric apparatus and like feed rate sensors have been suggested for controlling the milling procedure. By way of example, attention is directed to U.S. Pat. Nos. 1141,898; 2480,998; 3179,345; 3690,570 and 3779,469.

It will be readily recognized that the noted systems are, by and large, extremely expensive to install and maintain, are complex in their operation and, where variations in conditions (i.e. where the raw materials differs in particle size from typical, or where the apparatus it utilized to process a different material, for example from ore to sand) are experienced, the readjustment and resetting of the control mechanisms to accommodate the new conditions is laborious and requires substantial expertise.

Notwithstanding the existence of a multiplicity of automatic control systems, proportioning of ingredients in the majority of milling operations is today manually controlled, and the efficiency of the system is in large measure dependent upon the skill and experience of the operator.

SUMMARY

The present invention may be summarized as directed to a milling system which is simple and effective in its operation and which functions to increase the efficiency of milling capacity without reliance upon the expertise of the operating personnel.

The system employs a mill, such as a ball mill, a classifier for receiving the mixture emerging from the mill, such mixture including particles within and above the desired final size range. The extracted materials are fed to a classifier which separates the "fines" or finished product from the partly milled over-sized particles, the latter being fed to a proportioning device wherein they are mixed with additional raw materials, the mixture of raw and partially ground materials being fed to the ball mill.

The principal contribution of the present invention lies in the provision of an automatic proportioning device wherein the raw and partially ground materials are admixed, without resort to electronic sensors, such as microphones, photoelectric cells, feed rate sensors, etc. in a manner most efficiently to utilize milling capacity.

Briefly, the proportioning device includes a conveyor, such as an auger rotating in a channel or tube having a bore closely corresponding to the diameter of the flutes of the auger, the auger flutes thus, in effect, compartmentalizing or segmenting the unit. Partially ground materials are introduced at an upstream position within the channel at a maximum available rate, whereby the compartments or segments in the channel in registry with the partially ground infeed station is filled to the maximum possible extent, dependent upon the then available supply of such material. The conveyor continuously advances the fed increments of partially ground material toward a discharge end which communicates with the ball mill.

Interposed along the channel or conveyor and at a downstream position relative to the first mentioned receiving station there is positioned a second receiving station which operates on a gravity feed basis to introduce to the segments or compartments at a point or area in registry with the second station, quantities of raw material, the quantities introduced being permitted to enter into the space bounded by the upper surface of the already added materials and the under surface of the channel.

It will thus be appreciated that the infeed of raw material is a function of the amount of partially ground material in the proportioning device, i.e. if the segments or compartments of the proportioning device in registry with the second receiver station is completely choked with partially ground material (a condition which is unlikely to the encountered in normal operation), little or no raw material may enter the proportioning device, as it is blocked by the bulk of the partially ground material advancing beneath the second station. Where the quantum of partially ground material available at the first station is such that the cross section of the conduit is incompletely filled (a normal condition) and, thus, additional room exists between the underface of the infeed station for raw material and the upper surface of partially ground material, raw material will flow under gravitational influence and fill the noted void. The mix of raw and partially ground materials proceed to the ball mill under the influence of the conveyor.

A typical sand milling system wherein proportioning is manually performed by an experienced workman is capable of processing one and one half to two tons per hour. The identical unit, using the automatic proportioning feed described, is capable of processing between two and two and one half tons per hour.

It is accordingly an object of the present invention to provide a simple yet effective milling apparatus and method for optimizing through-put.

It is a further object of the invention to provide an improved milling system of the type described, incorporating means for automatically proportioning the amount of partially ground to raw materials introduced into the mill to optimize milling efficiency consonant with full utilization of the material being processed.

A further object of the invention is the provision of a device of the type described which is simple in its operation, eliminates the requirement of utilizing complex electronic circuits and sensors and which may readily accommodate itself to changes in operating conditions, such as changes in the range of size of finished product desired, and changes in particle size of raw materials.

To attain these objects and such further objects as may appear herein or be hereinafter pointed out, reference is made to the accompanying drawings, forming a part hereof, in which.

Figure 1:
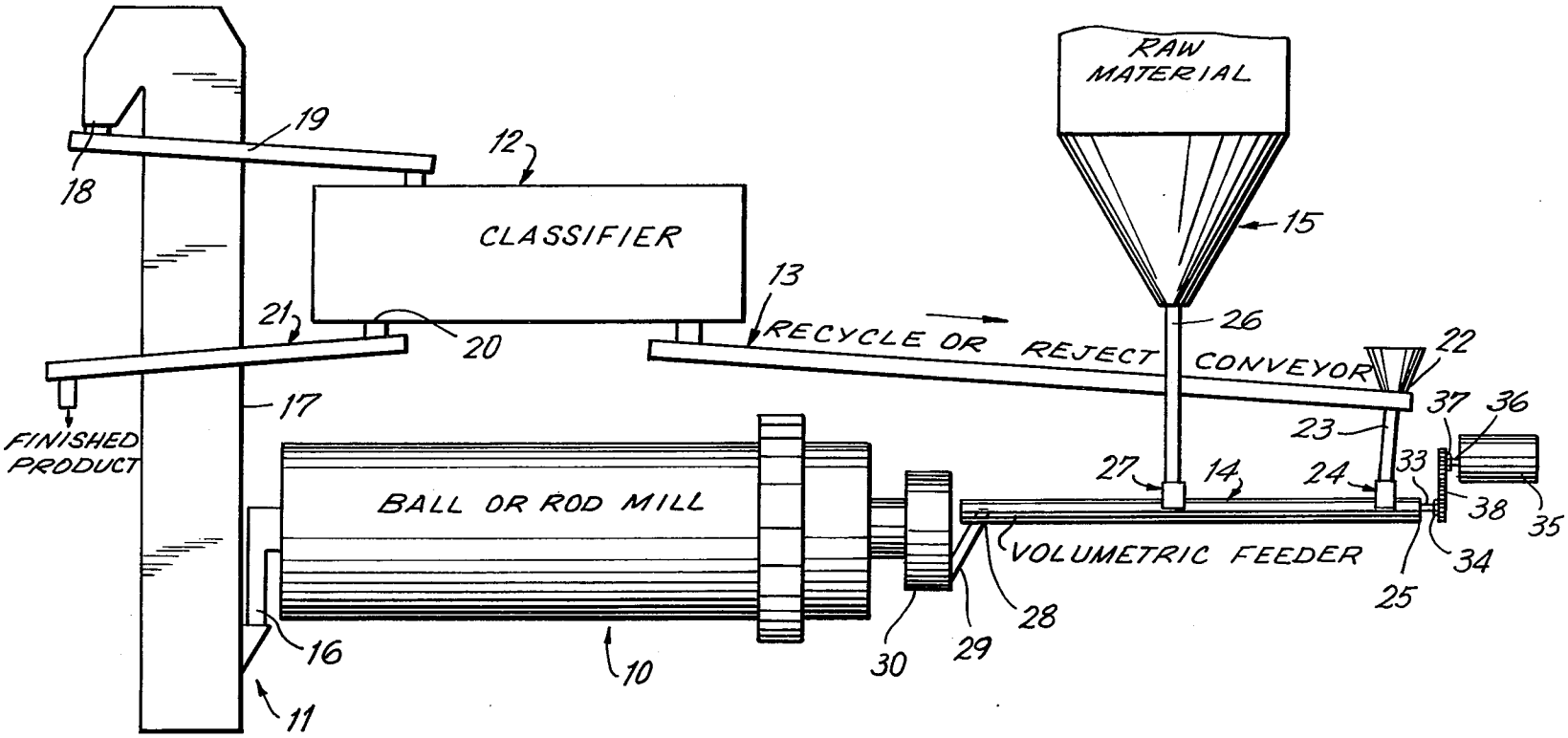
FIG. 1 is a schematic view of the milling system.

As conducive to an understanding of the present invention, there is shown in FIG. 1 a schematic diagram of a ball milling system in accordance with the invention. Except as hereinafter limited in the claims, the various components of the mill per se, and the associated parts, are by and large conventional and, accordingly, detailed description thereof need not be undertaken.

The principal elements of the system include a mill 10, which may be of the ball or rod type, by way of example, an extractor station 11 for removing the mixture of fines and incompletely ground materials from the mill, a classifier 12 for separating over-size particles from the fines, a first conveyor 13 for receiving partly ground materials, a volumetric feeder 14 for receiving and automatically proportioning raw materials from a bulk supply 15 with the partly ground material.

As is conventional with systems of this sort, raw material is generally admitted to the ball or rod mill on a continuous basis. Increments of material are continuously extracted from the mill at an exit station 16, and pass upwardly through the lift mechanism 17 where they are deposited at the entrance end of a classifier conveyor 19. The rate of infeed is of course coordinated with the rate of extraction to keep the quantity of material in the mill at any time essentially constant.

The mixture of finished product or fines and oversized material or "rejects" is advanced by the conveyor 19 to the classifier 12 which may, for instance, be an air classifier, whereat the increments which are milled to the desired range are extracted as at 20 and removed on the conveyor 21.

The over-sized, partially ground particles are received by the reject conveyor 13 and are advanced along the conveyor in the direction of the arrow, FIG. 1, to area 22 at the terminal end of the conveyor 13.

A depending gravity feed conduit 23 conducts the partially ground material into the volumetric feeder 14 at a first receiver station 24 adjacent the entrance 25 of the volumetric feeder.

Raw material from the bulk supply 15 is fed via conduit 26 to a second or downstream receiver station 27 interposed between the first receiver station 24 and the exit end 28 of the volumetric feeder. Conduit 29 receives the output of the volumetric feeder 14 and supplies the same to a loading station 30 leading to the ball or rod mill 10.

It is the function of the volumetric feeder 14 to intermix the over-size particles rejected by the classifier with the raw material, and feed such mixture at a selected rate for processing by the mill. Heretofore the proportioning operation was manually effected by more or less skilled operators, quantities of partially ground substance and quantities of raw material being admitted to the ball mill periodically in accordance with what experienced suggested would be a maximum efficiency rate.

In accordance with the preferred embodiment of the invention, the feeder 14 includes an elongate, generally cylindrical casing 31, within which casing is mounted an elongated auger member 32. The auger member includes a drive shaft 33 having a drive sprocket 34 mounted thereon. A drive motor 35, which may include a variable speed output includes a drive shaft 36 carrying a sprocket 37 linked to the drive sprocket 34 by drive chain 38.

The drive motor 35 operates to rotate the auger in a direction such that material within the casing 31 is shifted in the direction of the arrow from the input end 25 to the discharge end 28 of the feeder. The auger may include upstream of the first input station 24, a collector section 39 of relatively great pitch which functions to prevent the longitudinal spread of material in the direction of the shaft 33 and to compact any material which would tend to spill in such direction beneath the input station 24.

The input station 24 includes a downwardly directed orifice 40, surrounded by an input coupling 41, to which may be connected the conduit 23.

The second infeed station 27 for receiving raw materials includes a similar orifice 42 surround by a similar coupling 43, the coupling 43 preferably including inclined side wall portions 44 to reduce the likelihood of jamming at the input station.

The areas of the casing 31 directly beneath the input stations 24 and 27 preferably include nipples 45, 46, respectively, sealed by caps 47, 48, respectively, to facilitate cleaning and clearance of jams beneath the stations.

Figures 2, 3, 4:
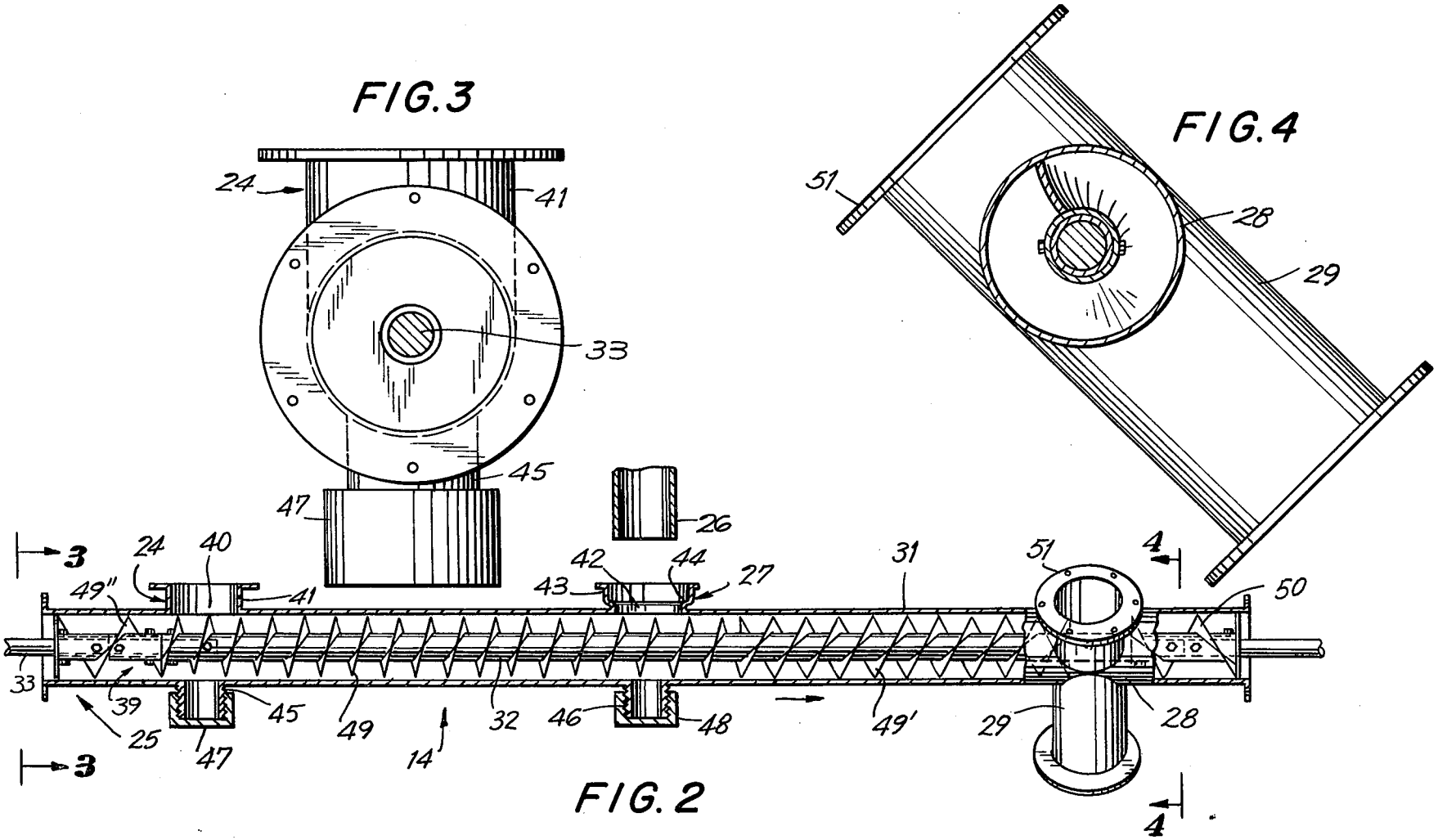
FIG. 2 is a vertical sectional view through the volumetric feeder portion of the device on a magnified scale as compared with FIG. 1.
FIG. 3 is a magnified section taken on the line 3—3 of FIG. 2.
FIG. 4 is a magnified section taken on the line 4—4 of FIG. 2.

As best appreciated from an inspection of FIG. 2, the pitch of the flutes 49 of the auger in the section spanning the stations 24 and 27 is more gradual than the pitch of the flutes 49' in the area immediately downstream of the second station 27 and extending to the discharge end 28. The auger preferably includes a series of reversely pitched flutes 50 immediately downstream of the discharge portion 28 in the casing.

Directly above the discharge end 28 of the volumetric feeder 14, there is preferably provided a fitting 51 which is normally capped, which fitting provides access to the area immediately beneath the discharge end or port 28.

OPERATION

The operation of the device will be described in connection with a typical installation for the milling of sand. In accordance with such installation, the casing 31 housing the auger 32 has an inside diameter of just over six inches, the maximum diameter of the auger flutes being about 6 inches. The auger is driven at a rotary speed of about 55 r p m and, if constantly driven as contemplated by the instant procedure, will pass approximately 125 cubic feet of sand per hour, amounting to about 6.2 tons. Obviously, the feed rate of the auger and extractor must be coordinated and varied, depending upon the material processed, particle size and amount of comminution sought.

The procedure is a continuous one, with a mixture of raw sand and recycled, over-sized sand being constantly advanced by the volumetric feeder to the ball or rod mill, a comparable amount of partially ground and completely ground materials being continuously removed from the mill at the exit station 16, passed upwardly through lift mechanism 17, and deposited in the classifier 12.

In practice, in the typical sand milling system hereinabove set forth, wherein the raw material is in a size range of 15 to 30 mesh and is sought to be reduced to a size range of 100 to 200 mesh, the ratio of rejects or partially ground material to fines averages about 2.2 : 1.

It will be understoodthat the finished product received from the classifier is removed via classifier output station 20 and conveyor 21 for packaging or other use. The remaining materials are returned by the first conveyor 13 from the classifier to the infeed area 22 connected via gravity feed conduit 23 to the first infeed or receiver station 24 of the volumetric feeder.

The material will fall into the casing 31 in the area in registry with the infeed orifice 40 and, depending upon the rate of feed of partially ground material, will partially fill the space between segments or flutes of the auger within the conveyor below the infeed orifice 40. By reason of the steeply pitched flutes 49'' upstream of the infeed station 24, the material falling into the auger at the infeed station is maintained in a compacted condition, with little tendency to spill or flatten in an upstream direction.

The material is continuously advanced by the auger from the first infeed station 24 toward the second infeed station 27. A head of raw material is continuously maintained in bin 15 to feed the conduit 26 disposed over the station 27.

The flow of material in the conduit 26 and through orifice 42 of the station 27 is, in accordance with the instant apparatus, limited by the amount of space available between the level of material in the auger and the upper configuration of the casing. Manifestly, if by reason of some unusual circumstance in the operation of the device, the entirety of the casing 31 is filled with recycled, partially ground material, virtually no additional raw material will be permitted to enter into the casing from the raw material bin 15. In the normal operation, the over-sized material emerging from the classifier and introduced at the station 24 will occupy only a portion of the available space within the casing, leaving a space thereabove for the introduction of raw material. The space which is left is more or less representative of the volumetric loss occasioned by extraction of fines or finished products.

From the above it will be appreciated that a quantity of raw material will be continuously added to provide a proportioned mixture of raw material and partially ground material which automatically compensates for variations in the efficiency with which the mill is operating.

It will be further understood that the system is advantageous in that the necessity for providing any significant storage capacity for partially ground materials is eliminated since such materials are added immediately as they are collected from the classifier. The available quantity of partially processed materials, in fact, governs the quantum of raw materials added at the second infeed station 27.

The proportioning feed of the apparatus is able automatically to compensate for variations in the average particle size of the raw material and for variations in the size of materials which are extracted. By way of illustration, if the classifier is set, by suitable adjustment thereof, to extract as finished product particles of a larger size than the normal run, it will be evident that a larger share of the materials fed to the classifier will be removed and a smaller quantity of partially ground materials will be recirculated. Under these circumstances, the area remaining above the second infeed station will be greater, and a larger amount of raw material will automatically be admitted to the interior of the casing.

As previously noted, the pitch of the flutes 49 in the area between the two infeed stations 24, 27 is less than the pitch of the flutes 49' in the area downstream of the second infeed station 27,. Manifestly, the maximum feed rate of the conveyor will be governed by the slower advance flutes 49, the more abruptly pitched flutes or flights serving to accelerate the material after passage beyond the station 27.

The reverse flutes 50 downstream of the discharge end 28 of the feeder are effective to return any material which may have passed beyond the discharge conduit 29 into the area in registry with the conduit.

With the above described device, outputs of from two to two and one half tons per hour of finished material may be readily achieved by an unskilled operator. In contrast, in the absence of the volumetric feeder assembly, skilled operators who manually introduce recycled, partially ground material and raw material mix in accordance with their experience are unable to obtain efficiencies over two tons per hour, the average efficiency of such skilled operators being in the area of one and one half to two tons. Use of the automatic proportioning device has thus improved efficiency in the neighborhood of from 20 to 25%, while at the same time eliminating the necessity for employing skilled operators.

While the above mentioned grinding system has been described in conjunction with a ball or rod mill device, it will be evident that other types of mills may beneficially employ such system.

Moreover, while the device has been described in the processing of sand, it will be readily recognized that any material of particulate nature which must be ground or milled in the course of processing may advantageously employ the system with its automatic proportioning device.

Still other and further variations may occur to those skilled in the art in the light of the above disclosure. By way of example, while the proportioning apparatus has been described in conjunction with an auger feed, alternate and equivalent feed mechansims which permit an automatic rationing of material at the second infeed station as a function of the amount of material admitted in the first infeed station may be suitably employed. Generally such feeders must take a form in which the material is constrained from freely spreading longitudinally within the proportioning device.

Accordingly, the invention is to be broadly construed within the scope of the appended claims.

Having thus described the invention and illustrated its use, what is claimed as new and is desired to be secured by Letters Patent is:

1. In a grinding mill system for sand or the like, said system including a mill, classifying means for receiving ground materials from the mill and separating over-sized particles from finished product, first conveyor means for receiving said over-size ground material, a feed device including a feed channel, said channel including an entry end and a discharge end connected to said mill, second conveyor means movably mounted in said channel for advancing material to said discharge end, said second conveyor means including transverse separator portions extending into proximate spaced relation with the inner walls of said channel and dividing said channel into a series of longitudinally extending segments, a first receiver station in said channel adjacent said entry end and connected to said first conveyor means for receiving and introducing into said channel said partially ground materials from said first conveyor, a second receiver station interposed between said discharge end and said first receiver station, and gravity feed means at said second receiver station for introducing said raw material into the area beneath said second station and bounded by the surface of the material introduced at said first receiver station and said separator portions of said second conveyor at a rate to substantially fill said conveyor in said area beneath said second receiver station, whereby the quantity of said raw material introduced at said second station automatically varies as a function of the level of the material beneath said second station which was introduced at said first station.

2. Apparatus in accordance with claim 1 wherein said channel comprises a cylindrical bore and said second conveyor means comprises an auger rotatably mounted in said bore.

3. Apparatus in accordance with claim 2 wherein said bore is substantially horizontally disposed.

4. Apparatus in accordance with claim 3 wherein said auger includes a section of a first pitch extending from said first to said second receiver station, and a section of a second and greater pitch downstream of said second receiver station.

5. Apparatus in accordance with claim 1 wherein said second receiver station comprises an opening in the upper surface of said channel.

6. Apparatus in accordance with claim 1 wherein said channel is of a substantially uniform cross section.

* * * * *